US006499228B2

(12) United States Patent
Nakhei-Nejad

(10) Patent No.: US 6,499,228 B2
(45) Date of Patent: Dec. 31, 2002

(54) PISTACHIO PRE-DRYER

(76) Inventor: Mohammad Nakhei-Nejad, #402, 10721 Saskatchewan Drive, Edmonton, AB (CA), T6E 6J5

( * ) Notice: Subject to any disclaimer, the term of this patent is extended or adjusted under 35 U.S.C. 154(b) by 35 days.

(21) Appl. No.: 09/681,705

(22) Filed: May 23, 2001

(65) Prior Publication Data

US 2002/0174560 A1 Nov. 28, 2002

(51) Int. Cl.[7] ..... F26B 19/00

(52) U.S. Cl. ..... 34/215; 34/216; 34/233; 426/465

(58) Field of Search ..... 34/201, 209–211, 34/215–218, 232–234, 237, 238; 426/615, 629, 632, 640, 420, 443, 453, 465, 466, 482; 99/467, 473–477

(56) References Cited

U.S. PATENT DOCUMENTS 822,105 A 5/1906 Eklund
4,034,665 A 7/1977 McFarland et al.
4,353,931 A 10/1982 Volk, Sr.
4,448,115 A 5/1984 Volk, Sr.
RE31,979 E 9/1985 Volk, Sr.
4,874,097 A 10/1989 Argiriadis
5,245,918 A 9/1993 Volk, Sr.
5,329,845 A 7/1994 Bichel
5,879,734 A 3/1999 Broyles

FOREIGN PATENT DOCUMENTS

GR 654-15 8/1980

*Primary Examiner*—Ira S. Lazarus
*Assistant Examiner*—Andrea M. Ragonese
(74) *Attorney, Agent, or Firm*—Bennett Jones LLP

(57) ABSTRACT

An apparatus for drying and conveying pistachios comprises a plurality of fixed and moveable slotted plates. The moveable plates are interleaved with the fixed plates and reciprocate to push pistachio nuts along the surface of the plates. Heated air is blown through the plates to dry the pistachios.

11 Claims, 3 Drawing Sheets

PISTACHIO PRE-DRYER

BACKGROUND OF INVENTION

The present invention relates to an apparatus for drying pistachio nuts during processing.

Pistachio nuts have a hard shell around the edible nut and a pericarp or hull which encases the shell. The hull of unripened pistachios adheres strongly to the shell and is difficult to remove whereas the hull is relatively easily removed from ripe pistachios. It is necessary to mechanically hull pistachios in order to process commercial quantities of the nut. Once hulled, blanks may be separated from the pistachios by immersing the pistachios in a flotation tank and allowing the good pistachios to sink and be collected. These pistachios should then be partially dried for further processing.

SUMMARY OF INVENTION

In general term, the invention provides a method and apparatus for drying and conveying pistachio nuts or other small objects. The pistachios are deposited onto a plurality of moving and fixed plates or trays. The moveable plates are interleaved with the fixed plates. All plates are inclined and slotted. The moveable plates reciprocate back and forth, pushing the pistachios to one end of the apparatus. At the same time, heated air is forced through the plates to dry the pistachios.

Therefore, in one aspect, the invention comprises an apparatus for drying and conveying small articles such as pistachio nuts comprising:(a)a plurality of inclined, interleaved fixed and moveable planar plates, wherein each plate: (1) overlaps an adjacent plate and is parallel to the adjacent plate; (2) defines a plurality of openings which are smaller than the article to be dried and conveyed; (3) wherein moveable plates are moveable along a plane parallel to the plane of an adjacent fixed plate; (b) means for reciprocating the moveable plates; and(c)means for blowing air through the plates.

The apparatus further comprises an air plenum beneath the plates for directing heated air through the plates. In one embodiment, the plates are rectangular. The plate reciprocation means may comprise a substantially horizontal elongate beam which is reciprocated horizontally, wherein each moveable plate engages the beam, at least one ramp supporting the beam and having an angle of inclination substantially equal to angle of inclination of the plates and means for reciprocating the beam. The beam reciprocation means may comprise a reciprocating shaft operatively connected to a motor by means for translating rotational movement to horizontal movement.

The motion translation means may comprises a circular disk having a non-central pin, a vertical channel engaging the pin, wherein said vertical channel engages the reciprocating shaft.

BRIEF DESCRIPTION OF DRAWINGS

The invention will now be described by way of an exemplary embodiment with reference to the accompanying simplified, diagrammatic, not-to-scale drawings. In the drawings.

DETAILED DESCRIPTION

The present invention provides for an apparatus which dries and conveys pistachios nuts. Because this apparatus is intended to partially dry the pistachio nuts before further processing, it is referred to herein as a "predryer". When describing the present invention, all terms not defined herein have their common art-recognized meanings. However, the present invention is not intended to be limited by the degree of drying which is accomplished nor is the following specific description of one embodiment intended to be limiting of the claimed invention.

Although the predryer is intended for pistachio nuts, one skilled in the art will appreciate that it may be used or adapted for use to dry and convey any small articles, such as other nuts, berries or beans.

Figure 1A:
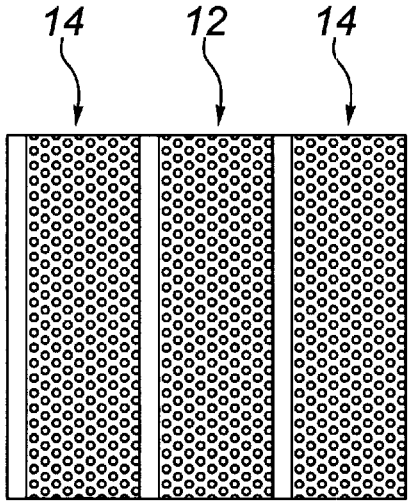
FIG. 1A is a top view of the plates.
Figure 1:
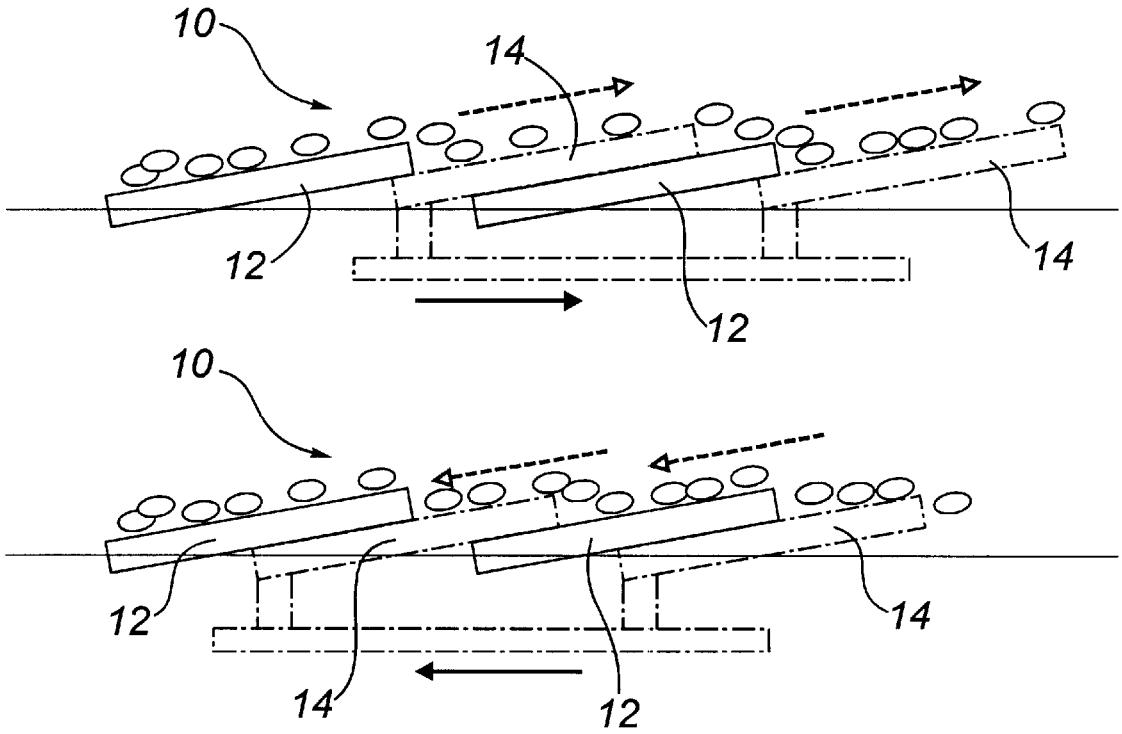
FIG. 1 is a schematic representation of a cross-sectional view of the plates of one embodiment of the invention.

The predryer comprises a plurality of rectangular plates (10) which are parallel to each other, inclined and overlap each other as is shown in FIG. 1. The basic principle of operation is illustrated in FIG. 1. Every other plate is fixed in position (12). The non-fixed plates (14) are interleaved with the fixed plates (12) and reciprocate to push the pistachios along the tops of the plates in a stepped fashion.

Figure 2:
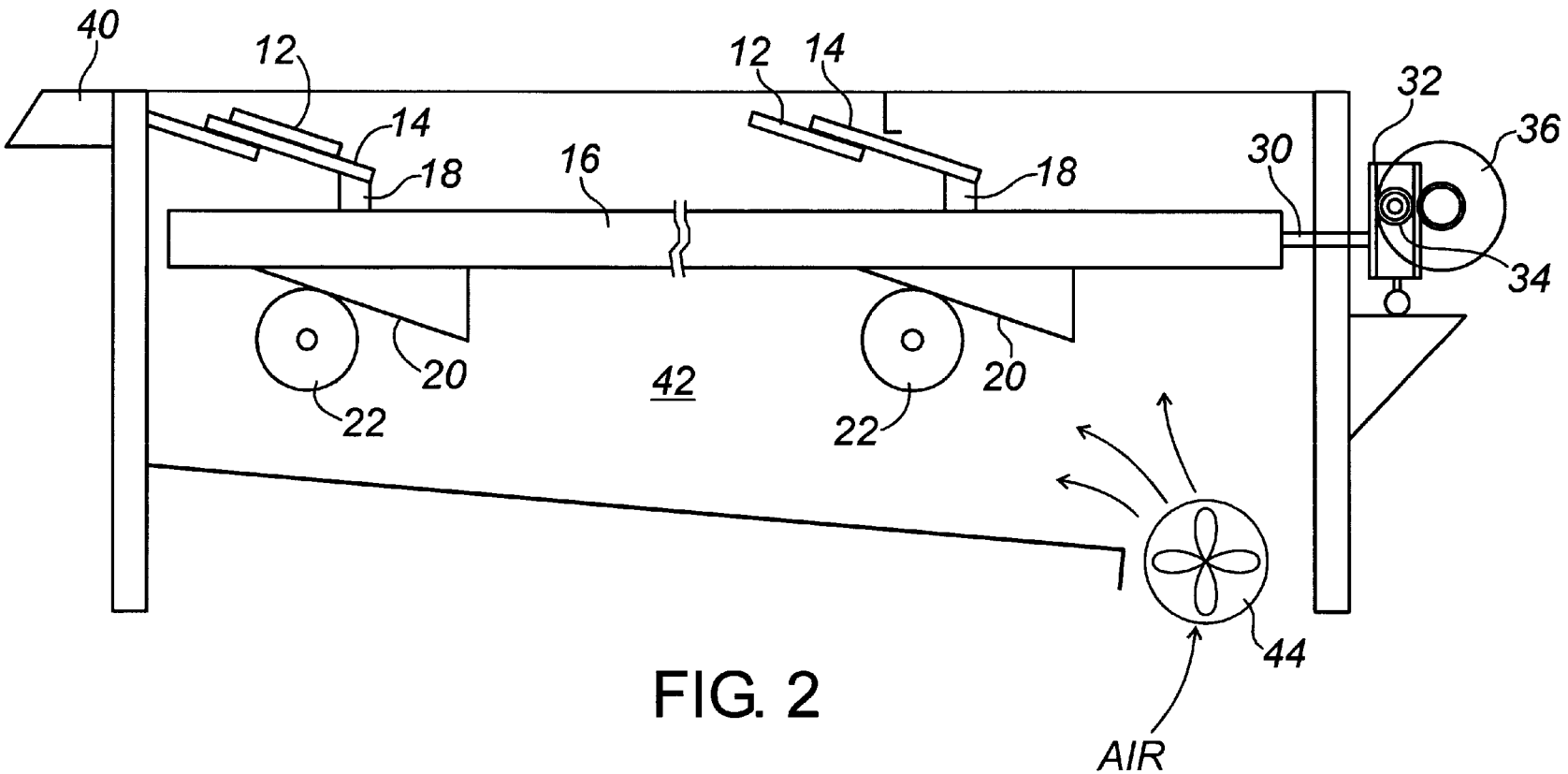
FIG. 2 is a vertical cross-sectional view of one embodiment of the invention.

As shown in FIG. 2, the plates (14) are reciprocated by means of a reciprocating beam (16) disposed beneath the plates (10) and attached by struts (18) to the moveable plates (14). The reciprocating beam (16) includes inclined ramps (20) which ride on rollers (22). The ramps (20) are inclined identically to the inclination of the plates (10) so that the plates (14) slide in between the adjacent fixed plates (12) in a parallel manner. As may be appreciated by one skilled in the art, in an alternative embodiment, the beam (16) may be mounted on skids which ride up fixed ramps, which would accomplish the same result.

Figure 4:
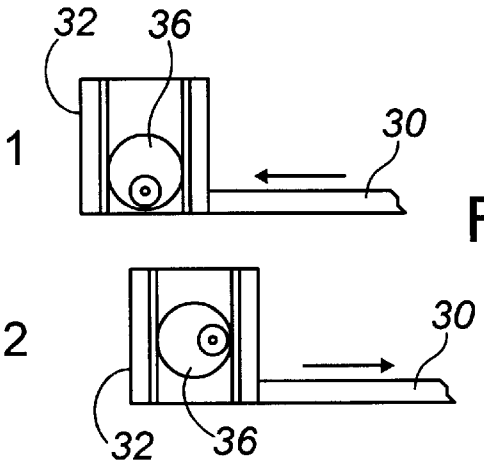
FIG. 4 is a schematic representation of a reciprocating means of one embodiment.

The reciprocating beam (16) is pushed and pulled by a shaft (30) which is attached to a vertical channel (32). A pin (34) which is eccentrically attached to a circular disk (36) which may be driven by an electric motor (38). As is apparent, rotation of the disk (36) causes the pin (34) to reciprocate within the vertical channel (32) and causes the reciprocating shaft (30) to reciprocate laterally as shown in FIG. 4. The reciprocating beam ramp (20) rides up the fixed rollers (22), imparting the reciprocating motion to the inclined plates (14). Alternative means to reciprocate the beam and the plates will be apparent to those skilled in the art.

The reciprocating motion of the plates (14) pushes the pistachios along the tops of the plates (10) to the end of the predryer where they are collected in a collection tray (40). The pistachios also tumble as they are pushed along by the plates allowing for a more uniform drying process.

The plates are slotted with openings smaller than the pistachio nuts. The area beneath the plates is enclosed and acts as a large plenum (42) for heated air which is forced through the plates by a blower (44). The heated forced air dries the pistachios as they pass over the plates. The air may be heated by electrical elements (not shown) or by a fuel burner such as a propane or natural gas heater (not shown).

Figure 3:
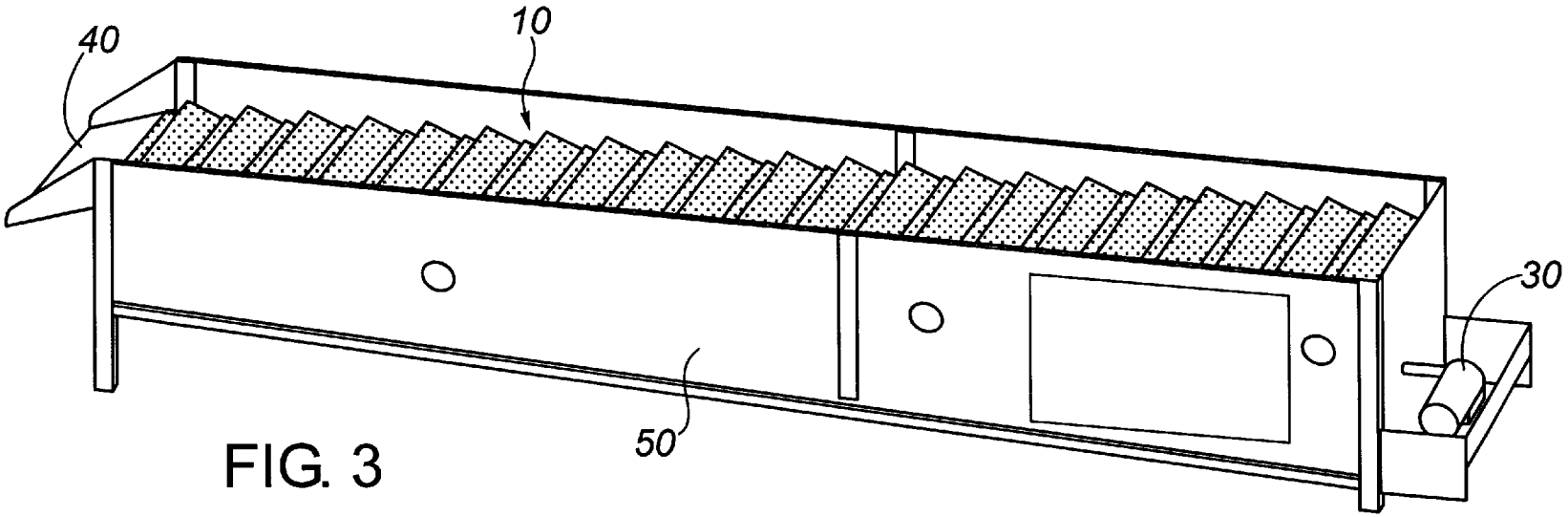
FIG. 3 is a pictorial view of a predryer of the present invention.

As is shown in FIG. 3, the plates (10) are disposed between side walls (50) which contain the pistachios above the plates (10) and which encloses the air plenum (42) below the plates (10).

As will be apparent to those skilled in the art, various modifications, adaptations and variations of the foregoing specific disclosure can be made without departing from the scope of the invention claimed herein.

What is claimed is:

1. An apparatus for drying and conveying small articles comprising:

a plurality of inclined, interleaved fixed and moveable planar plates, wherein each plate:

(1) overlaps an adjacent plate and is parallel to the adjacent plate;

(2) defines a plurality of openings which are smaller than the articles to be dried and conveyed;

(3) wherein moveable plates are moveable along a plane parallel to the plane of an adjacent fixed plate;

means for reciprocating the moveable plates; and means for blowing air through the plates.

2. The apparatus of claim 1 further comprising an air plenum beneath the plates.

3. The apparatus of claim 1 wherein the plates are rectangular.

4. The apparatus of claim 1 wherein the plate reciprocation means comprises a substantially horizontal elongate beam which is reciprocated horizontally, wherein each moveable plate is fixed to the beam, at least one ramp supporting the beam and having an angle of inclination substantially equal to angle of inclination of the plates and means for reciprocating the beam.

5. The apparatus of claim 4 wherein the beam reciprocation means comprises a reciprocating shaft operatively connected to a motor by means for translating rotational movement to horizontal movement.

6. The apparatus of claim 5 wherein the motion translation means comprises a flywheel having a non-central peg, a vertical channel engaging the peg, wherein said vertical channel engages the reciprocating shaft.

7. The apparatus of claim 2 wherein the means for blowing air through the plates further comprises means for heating the air.

8. The apparatus of claim 7 wherein the air blowing and heating means comprises a fan and an electric heating element.

9. The apparatus of claim 7 wherein the air blowing and heating means comprises a fan and a fuel burner.

10. An apparatus for drying and conveying small articles comprising:

a plurality of inclined planar plates, wherein each plate: overlaps an adjacent plate;

is parallel to the adjacent plate; and defines a plurality of openings which are smaller than the articles to be dried and conveyed;

wherein every other plate is fixed, and wherein non-fixed plates are moveable along a plane parallel to the plane of an adjacent fixed plate;

a substantially horizontal elongate beam which is reciprocated horizontally, wherein each moveable plate engages the beam, at least one ramp supporting the beam and having an angle of inclination substantially equal to angle of inclination of the plates and a reciprocating shaft operatively connected to a motor by means for translating rotational movement to horizontal movement; and a blower and a heater for blowing heated air through the plates.

11. The apparatus of claim 1 or 10 wherein the articles are pistachios, nuts, berries or beans.

* * * * *